US005789037A

United States Patent [19]

Denton et al.

[11] Patent Number: 5,789,037

[45] Date of Patent: Aug. 4, 1998

[54] CROSS-LINKING AGENT AND PROCESS FOR CROSS-LINKING BINDER AND TEXTILE COLORANT ON A TEXTILE FABRIC

[75] Inventors: William R. Denton, Spartanburg; James K. Knox, Union, both of S.C.

[73] Assignee: Premier Colors, Inc., Union, S.C.

[21] Appl. No.: 792,084

[22] Filed: Jan. 31, 1997

[51] Int. Cl.[6] ..... B05D 3/02

[52] U.S. Cl. ..... 427/387; 8/496; 427/393.4; 427/429; 525/474

[58] Field of Search ..... 427/387, 393.4; 8/496; 525/474; 422/429

[56] References Cited

U.S. PATENT DOCUMENTS 4,248,593 2/1981 Reinhardt ..... 8/532
4,344,765 8/1982 Reinhardt et al. ..... 8/471
4,365,967 12/1982 Guth et al. ..... 422/393.4 X
4,863,483 9/1989 Donenfeld et al. ..... 8/496

*Primary Examiner*—Michael Lusignan
*Attorney, Agent, or Firm*—Adams Law Firm, P.A.

[57] ABSTRACT

A cross-linking agent for cross-linking a binding agent with a pigment for coloring textile fabrics in a continuous padding process including an emulsified mixture of at least 500% by weight of silicone fluid, at least 20% resin, at least 10% water and optional processing enhancers.

An embodiment of the method for padding pigment colors onto textile fabrics according to the invention includes the steps of preparing a padding liquor of a cross-linking agent, a textile pigment, a binder and water, wherein the cross-linking agent is an emulsification of at least 50% by weight of silicone fluid, at least 20% resin, and at least 10% water. The padding liquor is then padded onto the textile fabric, and the resin in the padding liquor is cured on the textile fabric to cross-link the pigment and the binder.

9 Claims, 1 Drawing Sheet

CROSS-LINKING AGENT AND PROCESS FOR CROSS-LINKING BINDER AND TEXTILE COLORANT ON A TEXTILE FABRIC

TECHNICAL FIELD AND BACKGROUND OF THE INVENTION

This invention relates to an agent which improves the cross-linking of a binder and textile colorant on a textile fabric, and a process for using the cross-linking agent. The cross-linking agent and process have particular application in padding a textile colorant, such as an organic pigment onto textile fabrics. This process is called "continuous dyeing" or "pigment padding." Typically, the process utilizes pigment inks for light shades and dispersed dyes for dark shades which are applied to the fabric in a bath to achieve one solid color saturation of all fibers in the entire width and length of the fabric.

Heretofore, pigments have not been suitable for pigment padding dark shades, since prior art processes have not been able to achieve acceptable wash fastness and resistance to crocking.

Crocking characteristics and wash-fastness are critical determinants of the quality of textile printing and continuous dyeing operations. These characteristics are determined by the extent to which the coloring agent cross-links with a binder which bonds with the fibers of the textile fabric.

Traditionally, control of crocking and wash-fastness characteristics are controlled by introducing multiple additives into the dye batches. These additives include viscosity regulators, emulsifiers and the like. Processing conditions are so variable from plant to plant that the "recipe" is typically the result of trial and error, and almost constantly varies.

Since pigment dyes have not been suitable for continuous dyeing, dyers have been required to use dispersed dyes or fiber reactive dyes to achieve quality results for dark shades and higher quality medium shades. This process is very expensive as compared to a process using pigment inks. After padding on the dispersed or reactive dyes, the fabric has to be rinsed in a special bath, then fixed with a steam ager, then rinsed again, and then dried. Usually, the fabric will be run through another bath which will apply a special fixation agent and the fabric is re-cured.

The invention of the present application originated from an attempt to find an "all-in-one" premixed and packaged product to be furnished to plants, and which would provide consistent, enhanced wash-fastness and crocking characteristics, avoiding the need for individual printing plants to purchase and inventory a wide range of processing chemicals for mixing into textile printing mixtures. Original efforts resulting in products which were expensive and frequently gelled, formed hard granules or polymerized into rock-hard lumps in the barrels. Over a period of time many plant trials directed to determining volume, equipment, speeds, curing temperatures and curing dwell times resulted in a pre-mixed composition which was relatively stable and consistent from batch to batch. Changes in the cross-linking agent which enhanced performance included an increase in the amount of surfactants used and a reduction in both the amount of silicone fluid and resin, which resulted in better emulsification and less stratification from top to bottom of the cross-linking agent. In addition, the order of mixing was changed, with the resin being added only after pH has stabilized at the desired level.

As an additive to fabric printing pigment ink mixtures, it was learned that fabric print quality was greatly improved, resulting in the fabric consistently passing a 4A AATCC wash test and improving the crocks to a 45 AATCC range. In addition, the cross-linking additive improved binder cross-linking to the point where the print machines could run faster, while obtaining improvements in color strength and brightness by 10–30%, while using less pigment inks.

Subsequently, experimentation directed towards attempting to salvage printed fabrics which failed wash and/or crocking tests revealed that these characteristics could be brought up to an acceptable standard by re-running the fabric through a textile fabric padding operation to apply a padding solution of the cross-linking agent and latex binder to the previously dyed fabric. Upon curing, there was a very substantial improvement in both wash-fastness and crocking.

It has since been discovered that a cross-linking agent according to the invention can be mixed with organic pigments in a continuous padding process to achieve rich, deep, saturated dark colors with very high wash-fastness and very low crocking. This is a significant development, since while light shades of pigment inks can be successfully applied in continuous padding processes, the attempted use of pigment inks for deep, dark, rich shades historically produced dull, flat color and completely unacceptable crocking.

The organic pigment is suspended in a matrix which includes the cross-linking agent, a binder and water to form a padding liquor which is applied to fabric as the fabric moves rapidly along a processing line.

The cross-linking agent and the process by which the agent is used results in significant savings.

SUMMARY OF THE INVENTION

Therefore, it is an object of the invention to provide a cross-linking agent for continuous padding of textile fabrics which results in superior wash-fastness.

It is another object of the invention to provide a cross-linking agent for continuous padding of textile fabrics which results in very low crocking of even dark, saturated colors.

It is another object of the invention to provide a cross-linking agent for continuous padding of textile fabrics which substantially reduces roller clean-up on the padding line.

It is another object of the invention to provide a cross-linking agent for -continuous padding of textile fabrics which permits the use of relatively inexpensive organic pigments rather than expensive dyes.

It is another object of the invention to provide a cross-linking agent for continuous padding of textile fabrics which can be added to the pigment and binder in one application as an "all-in-one" product.

It is another object of the invention to provide a cross-linking agent for continuous padding of textile fabrics which can be applied to an already dyed fabric to bring unacceptable wash-fastness and/or crocking up to acceptable standards.

It is another object of the invention to provide a method of for padding deep, rich, saturated pigment colors onto textile fabrics.

It is another object of the invention to provide a method of for padding a cross-linking agent onto previously dyed or pigmented textile fabrics to enhance fabric quality.

These and other objects of the present invention are achieved in the preferred embodiments disclosed below by providing a cross-linking agent for cross-linking a binding agent with a pigment for coloring textile fabrics in a continuous padding process, comprising an emulsified mixture of at least 50% by weight of silicone fluid, at least 20% resin and at least 10% water.

According to one preferred embodiment of the invention, the cross-linking agent includes at least 3% surfactants.

According to another preferred embodiment of the invention, the cross-linking agent includes triethanolamine and ammonia to stabilize pH.

According to yet another preferred embodiment of the invention, the pigment comprises an organic pigment.

An embodiment of the method for padding pigment colors onto textile fabrics according to the invention comprises the steps of preparing a padding liquor of a cross-linking agent, a textile pigment, a binder and water, wherein the cross-linking agent comprises an emulsification of at least 50% by weight of silicone fluid, at least 20% resin, and at least 10% water. The padding liquor is then padded onto the textile fabric, and the resin in the padding liquor is cured on the textile fabric to cross-link the pigment and the binder.

According to one preferred embodiment of the invention, the proportion of the mixture is approximately 1 part cross-linking agent, between 3 and 5 parts textile pigment, between 4 and 10 parts binder and between 3 and 5 parts water.

According to another preferred embodiment of the invention, the padding liquor comprises optional components selected from the group consisting of a softener for improving the hand of the colored textile fabric, an antimigrant for reducing pigment migration, a viscosity enhancer, a humectant and a wetting agent.

According to yet another preferred embodiment of the invention, the proportion of binder to pigment is between approximately 1.5–2.

Another process according to the invention for improving the wash-fastness and crocking characteristics of previously color-printed textile fabrics, comprises the steps of preparing a padding liquor of a cross-linking agent, a binder and water, wherein the cross-linking agent comprises an emulsification of at least 50% by weight of silicone fluid, at least 20% resin and at least 10% water, and then padding the padding liquor onto the previously color-printed textile fabric. The resin in the padding liquor is cured on the textile fabric to cross-link the color on the fabric with the binder applied during the padding step.

According to yet another preferred embodiment of the invention, the padding liquor comprises optional components selected from the group consisting of a softener for improving the hand of the colored textile fabric, an antimigrant for reducing pigment migration, a viscosity enhancer, a humectant and a wetting agent.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

The end product cross-linking agent according to a preferred embodiment of the invention is as follows:

| Component | Percent by weight |
|---|---|
| Silicone Fluid | 56.00 |
| Ethox (E-2657) | 3.00 |
| Ethox (E-2938) | 1.55 |
| Water | 13.35 |
| Triethanolamine 99% | 1.50 |
| Ammonia | 1.00 |
| Odor Neutralizer (Bubble Gum) | .40 |
| Aerotex 3730 (AERO-3730) | 23.00 |
| Conc. Alcoprint PTF | .20 |
| | 100.00 |

The silicone fluid is a Dow or GE 1000 centapoids non-emulsified silicone. The Ethox-brand products are commonly-known surfactants. The triethanolamine and ammonia are used to control pH. The Aerotex 3730 is the curable binding resin. Aerotex 3730 is a well-known water soluble melamine resin. Alcoprint PTF is viscosity regulator.

The cross-linking agent according to the above preferred embodiment of the present invention is prepared according to the following procedure:

The batch is preferably mixed in a 4500-pound open vat with a 30 hp. stator mixer which induces high shear in the product during mixing and produces frictionally-induced heat during mixing. The open vat is charged with the silicone fluid, and the mixer is then started. The surfactants and water are added and the mixer begins emulsifying the mixture. After five minutes, during which time the mixture begins to warm, the water, pH regulators and odor neutralizer are added. After five minutes more of mixing, the curable binding resin and the viscosity regulator are added. After the last component is added, the mixer continues mixing for one hour. The temperature of the mixture is checked. If the temperature is 125° F. or above, mixing is not resumed. If necessary to raise the temperature to 125° F. mixing is resumed until the proper temperature is reached. The pH is checked and should be between 8.5 and 9.5. Viscosity should be initially at 3000 cps., and should climb to between 5,000 and 6,000 cps after several days. This is the ideal processing viscosity.

Figure 1:
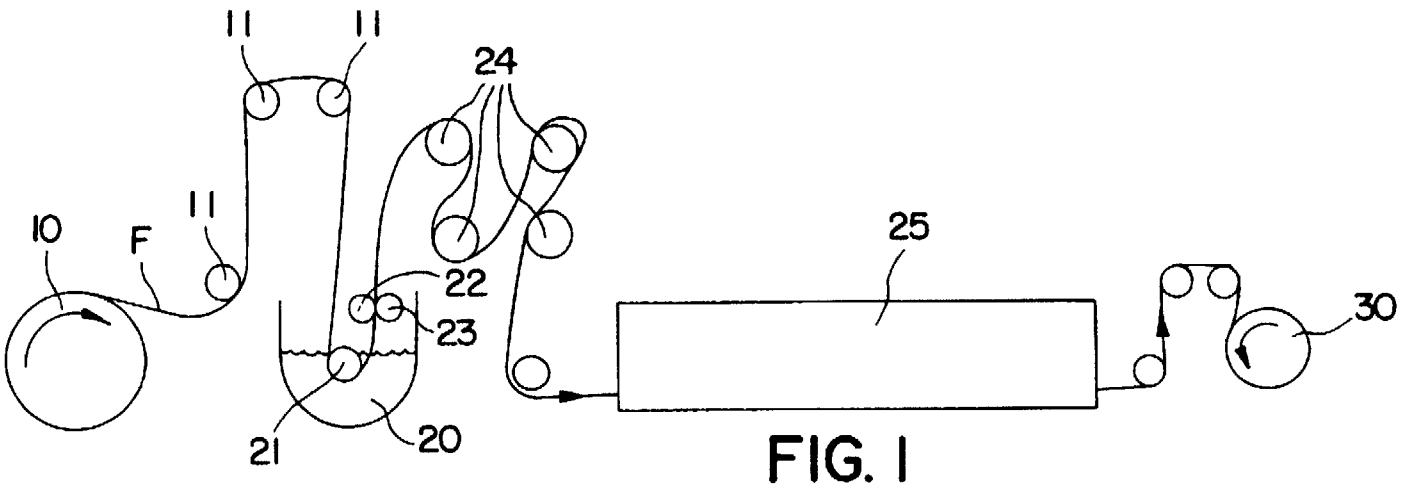
FIG. 1 is a schematic representation of a padding range of a type on which the process of the invention may be carried out.

Referring now to FIG. 1, the general process by which the cross-linking agent is used is illustrated. The fabric "F" to be padded with the padding liquor is taken from a roll 10 in a continuous process through a series of rollers 11 to straighten the fabric "F" and remove folds and wrinkles. The fabric "F" is passed through the padder 20 by the roller 21, and then through the rollers 22 and 23 where the padding liquor is forced into the structure of the fabric "F" and the excess removed. The fabric "F" is then passed through the pre-drying cans 24 and then through a tenter frame 25. Heat is applied to the fabric "F" as it passes through the tenter frame 25 to begin cross-linking between the binder and the pigment which results in the curing of the colorant in the fabric "F". The fabric "F" is then rewound onto a tubular roller 30 in preparation for shipping.

Figure 2:
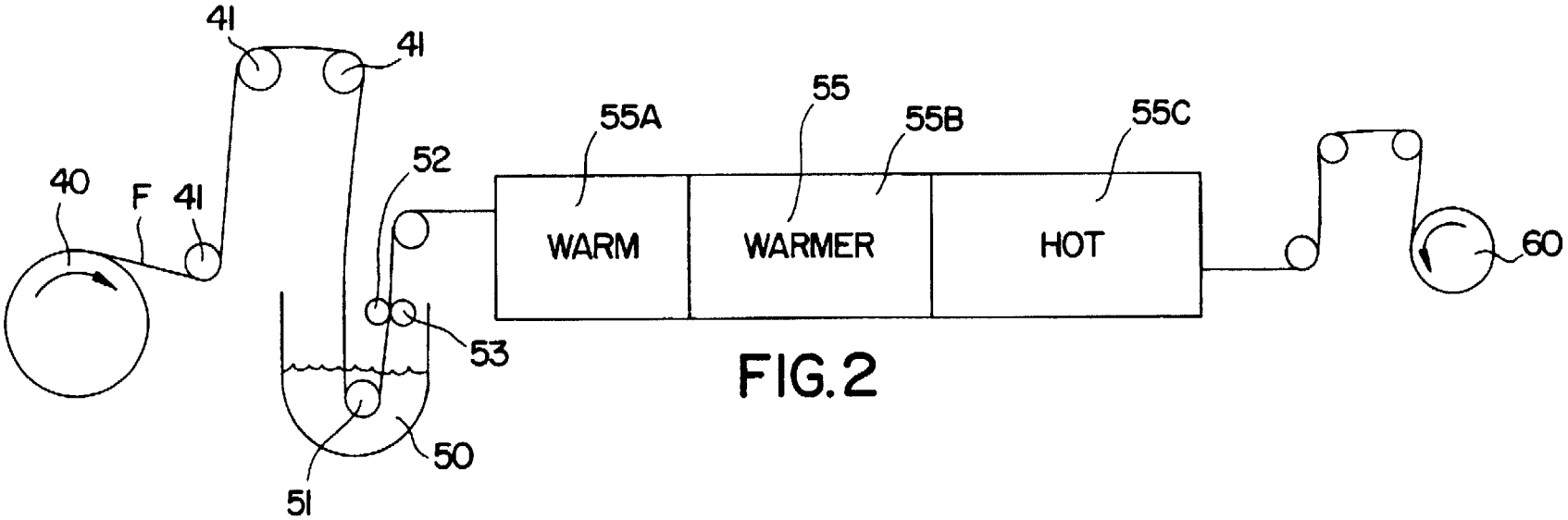
FIG. 2 is a schematic representation of a padding range of a type on which the process of the invention may be carried out.

In an alternative embodiment of the process shown in FIG. 2, the fabric "F" to be padded with the padding liquor is taken from a roll 40 in a continuous process through a series of rollers 41 to straighten the fabric "F" and remove folds and wrinkles. The fabric "F" is passed through the padder 50 by the roller 51, and then through rollers 52 and 53 where the padding liquor is forced into the structure of the fabric "F" and the excess removed. The fabric "F" is then passed through a tenter frame 55 which has several drying zones 55A, 55B and 55C and gradually increases to the final temperature required to properly cure the colorant to the fabric "F". The fabric "F" is then rewound onto a tubular roller 60 in preparation for shipping.

Specific examples of use of the cross-linking agent according to a preferred embodiment of the invention is set out above:

EXAMPLE 1

The cross-linking agent (CLA) of the preferred embodiment set out above is mixed with other ingredients to form a pad liquor, or padding liquor, as follows:

| Component | Percent by Weight |
|---|---|
| CLA | 5.00 |
| Pigment (Carbon black 2045A) | 20.00 |
| Binder (liquid acrylic) | 50.00 |
| Water (approx) | 21.00 |
| Antimigrant (CF 300) | 1.00 |
| Viscosity regulator and humectant (Ultralube 900) | 1.00 |
| Wetting agent (Ultrapenetrant PFC) | 1.00 |
| | 100.00 |

B.F. Goodrich WRL 0446 may be used instead of the Unicrock PB as the binder where particularly good dry-cleaning characteristics are desired.

The antimigrant is 3% Methocel A4C, 8% isopropyl alcohol and 3% sulphonated surfactant (Dysulf C70) and water. The viscosity regulator and humectant is 8 parts propylene glycol and 2 parts ethoxalated surfactant. The wetting agent is phosphated alcohol.

The padding liquor formulated as above was prepared according to the following directions:

The components of the base mixture should be slurried together until homogenous, not sheared under high speed mixing equipment. The base components should be charged into the pad bath vessel in the following order:

1. Water at 50°–90° F. The vessel's mixer must be started before adding any of the remaining components. The mixer is left running until all components, including pigment color, are charged and are homogeneously mixed.
2. Viscosity regulator and humectant;
3. Antimigrant;
4. CLA;
5. Binder
5. Pigment
6. Wetting agent A cotton/polyester fabric was processed in accordance with the process of the invention by padding the pad bath onto the fabric and then heating the fabric for 10–12 seconds while the fabric temperature is 325° F. Thus, production rates determine the temperature of the tenter frame 25 and the drying cans 30 and 35. On startup, a piece of the fabric is crock-tested to insure that proper curing is achieved at the particular equipment speeds and settings. Heat and speed settings must be adjusted to achieve the time and temperature parameters set out above.

EXAMPLE 2

The cross-linking agent (CLA) of the preferred embodiment set out above is mixed with other ingredients to form a padding liquor, as follows:

| Component | Percent by Weight |
|---|---|
| CLA | 5.00 |
| Pigment (Ultrared P400) | 24.00 |
| Binder (Unicrock PB) | 40.00 |
| Water (approx) | 28.50 |
| Antimigrant (CF 300) | 1.00 |
| Viscosity regulator and humectant (Ultralube 900) | 1.00 |
| Wetting agent (Ultrapenetrant PFC) | .50 |
| | 100.00 |

B.F. Goodrich WRL 0446 may be used instead of the Unicrock PB as the binder where particularly good dry-cleaning characteristics are desired.

The padding liquor formulated as above was prepared according to the directions set out for Example 1.

Alternatively, the padding liquor may be formulated without the binder and pigment and shipped to the customer for additional of the binder and pigment just prior to padding.

EXAMPLE 3

In this example the cross-linking agent was used to upgrade the quality of previously dyed fabric:

| | |
|---|---|
| CLA | 5.00 |
| Water | 92.00 |
| Binder (Unicrock PB) | 3.00 |
| | 100.00 |

B.F. Goodrich WRL 0446 may be used instead of the Unicrock PB as the binder where particularly good dry-cleaning characteristics are desired.

More generally, the recommended percentage ranges for padding mixtures according to the invention are as follows:

| Component | Light Shades | Medium Shades | Dark Shades |
|---|---|---|---|
| Ultralube 900 | 0.5% | 0.6–1.4% | 1.5–4.0% |
| Unipad Antimigrant CF300 | 0.5–1.0% | 0.5–1.0% | 0.5–1.0% |
| CLA | 0.0–0.5% | 0.6–1.4% | 1.5–6.0% |
| Ultra Penetrant BFC | 0.1–0.3% | 0.1–0.3% | 0.1–0.3% |
| Unicrock PB | 1.0–2.0% | 2 to 1 ratio of Crock PB to pigment | 2 to 1 ratio of Crock PB to pigment |
| Ultra pigment colors | Dependent on shade desired | Dependent on shade desired | Dependent on shade desired |

A cross-linking product which improves the cross-linking of a binder and textile colorant on a textile fabric, and a process for using the cross-linking agent is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A cross-inking agent for cross-linking a binding agent with an aqueous pigment ink for coloring textile fabrics in a continuous padding process, comprising an emulsified mixture of:

(a) at least 50% by weight of a non-emulsified silicone fluid;

(b) at least 20% of a water-soluble melamine resin; and (c) at least 10% water.

2. A cross-linking agent according to claim 1, and further including at least 3% surfactant.

3. A cross-linking agent according to claim 1, and further including triethanolamine and ammonia pH regulators.

4. A process for padding an aqueous pigment ink onto textile fabrics, comprising the steps of:

(a) preparing a padding liquor of a cross-linking agent, a textile pigment ink, a binder and water, wherein said cross-linking agent comprises an emulsification of:

(1) at least 50% by weight of a non-emulsified silicone fluid;

(2) at least 20% of a water-soluble melamine resin; and (3) at least 10% water;

(b) padding said padding liquor onto the textile fabric; and (c) curing the resin in the padding liquor on the textile fabric to cross-link the pigment ink and the binder.

5. A process according to claim 4, wherein the proportion of the mixture is approximately 1 part cross-linking agent, between 3 and 5 parts textile pigment, between 4 and 10 parts binder and between 3 and 5 parts water.

6. A process according to claim 5, wherein said padding liquor comprises optional components selected from the group consisting of a softener for improving the hand of the colored textile fabric, an antimigrant for reducing pigment migration, a viscosity enhancer, a humectant and a wetting agent.

7. A process according to claim 4, wherein the proportion of binder to pigment is between approximately 1.5–2.

8. A process for improving the wash-fastness and crooking characteristics of previously color-printed textile fabrics, comprising the steps of:

(a) preparing a padding liquor of a cross-linking agent, a binder and water, wherein said cross-linking agent comprises an emulsification of;

(1) at least 50% by weight of a non-emulsified silicone fluid;

(2) at least 20% of a water soluble melamine resin; and (3) at least 10% water;

(b) padding said padding liquor onto the previously color-printed textile fabric; and (c) curing the resin in the padding liquor on the textile fabric to cross-link the color on the fabric with the binder applied during the padding step.

9. A process according to claim 8, wherein said padding liquor comprises optional components selected from the group consisting of a softener for improving the hand of the colored textile fabric, an antimigrant for reducing pigment migration, a viscosity enhancer, a humectant and a wetting agent.

* * * * *